US006031193A

United States Patent [19]

Flegel

[11] Patent Number: 6,031,193

[45] Date of Patent: Feb. 29, 2000

[54] CIRCUIT BREAKER SWITCH INTERLOCK

[75] Inventor: David D. Flegel, Racine, Wis.

[73] Assignee: Reliance Controls Corporation, Racine, Wis.

[21] Appl. No.: 09/232,898

[22] Filed: Jan. 15, 1999

[51] Int. Cl.[7] ..... H01H 9/20

[52] U.S. Cl. ..... 200/50.33; 200/50 C

[58] Field of Search ..... 200/5 EA, 50.33, 200/50.35, 50.32, 43.16

[56] References Cited

U.S. PATENT DOCUMENTS

| | | | |
|---|---|---|---|
| 3,158,701 | 11/1964 | Nadeau | 200/50 |
| 3,198,898 | 8/1965 | Piteo, Jr. | 200/50 |
| 3,647,997 | 3/1972 | Nerem | 200/50 C |
| 3,705,280 | 12/1972 | Harms | 200/50 C |
| 3,778,633 | 12/1973 | De Visser et al. | 307/64 |
| 4,270,031 | 5/1981 | Borona et al. | 200/50 C |
| 4,510,357 | 4/1985 | Winterbottom | 200/50 R |
| 4,665,284 | 5/1987 | Guinan | 200/50 C |
| 4,902,859 | 2/1990 | Witzmann et al. | 200/50 C |
| 4,906,958 | 3/1990 | Adamson | 335/11 |
| 4,924,041 | 5/1990 | Yee | 200/50 C |
| 4,980,525 | 12/1990 | Kasisako | 200/50 R |
| 5,008,499 | 4/1991 | Yee et al. | 200/50 C |
| 5,109,142 | 4/1992 | VonKannewurff et al. | 200/50 R |
| 5,122,624 | 6/1992 | Benda | 200/43.14 |
| 5,172,087 | 12/1992 | Castonguay et al. | 335/160 |
| 5,189,385 | 2/1993 | Gnahn | 335/132 |
| 5,268,543 | 12/1993 | Ramos | 200/43.11 |
| 5,270,503 | 12/1993 | Frye | 200/43.14 |
| 5,310,969 | 5/1994 | Turek et al. | 200/43.14 |
| 5,322,980 | 6/1994 | Benda | 200/43.014 |
| 5,648,646 | 7/1997 | Flegel | 200/50.32 |

*Primary Examiner*—Michael L. Gellner
*Assistant Examiner*—Nhung Nguyen
*Attorney, Agent, or Firm*—Andrus, Sceales, Starke & Sawall

[57] ABSTRACT

An interlock for first and second tandemly aligned circuit breaker switches which respectively have first and second external operating handles thereon oriented such that the operating handles are disposed away from each other when the switches are OFF and towards each other when the switches are ON. The interlock includes a substantially inflexible control member movably and retainably mounted relative to the switches. The control member has first and second stops, each of the stops being disposed between the operating handles for engagement therewith. The control members are constructed and arranged such that pushing the first operating handle from an OFF to an ON position pushes the second operating handle from an ON to an OFF position. The control member also includes guide structure for guiding the control member along a central groove defined by the existing structure of the switches.

26 Claims, 3 Drawing Sheets

FIG. 1
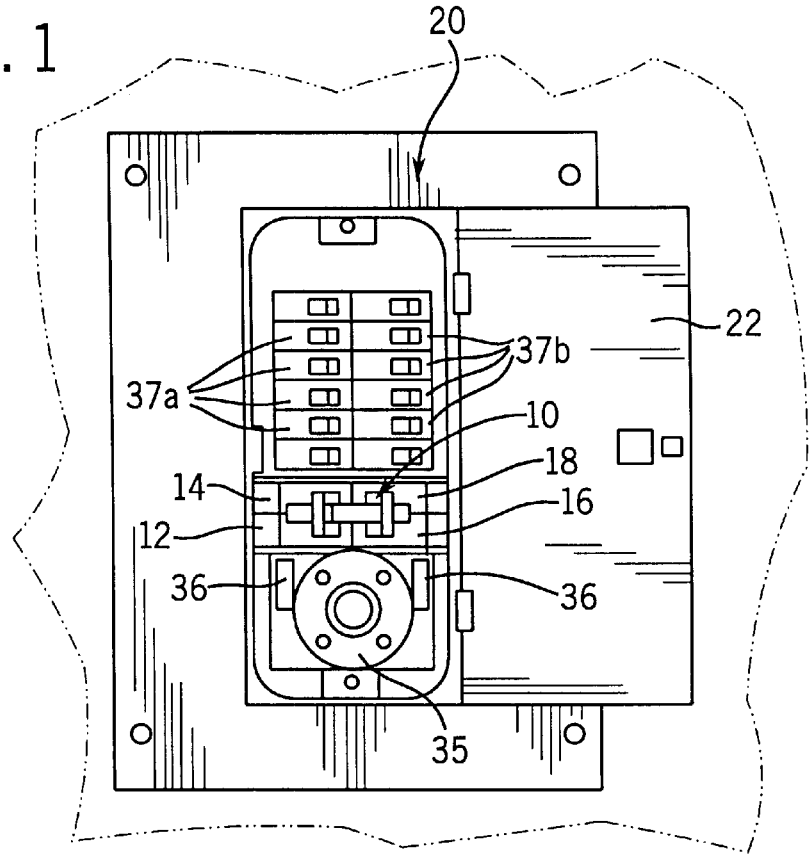
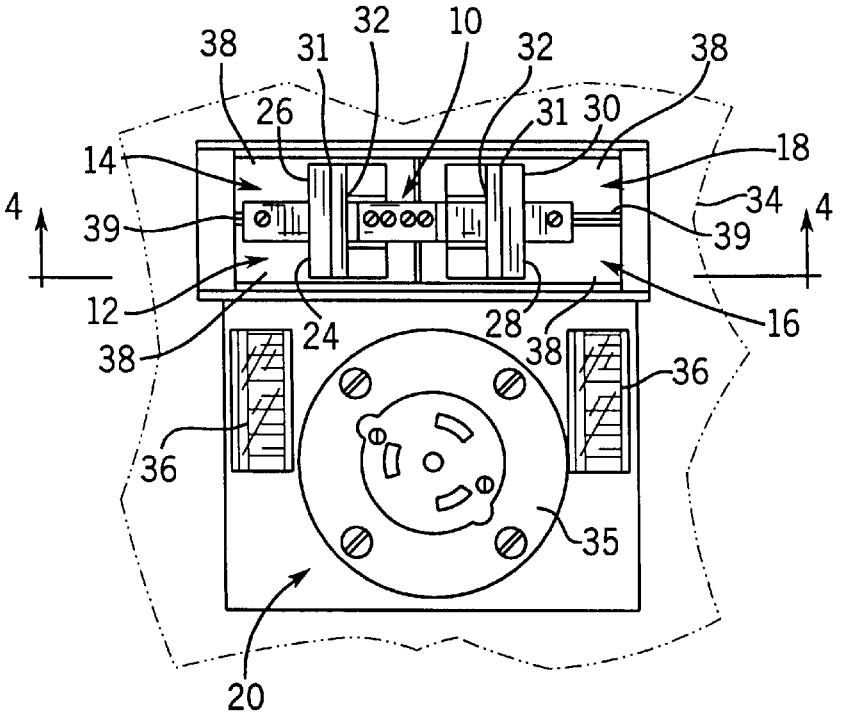
FIG. 2

CIRCUIT BREAKER SWITCH INTERLOCK

FIELD OF THE INVENTION

This invention is generally related to an interlock for circuit breaker switches and, more particularly, pertains to a circuit breaker switch interlock coupling two opposing circuit breaker handles and preventing both circuit breakers from being ON at the same time.

BACKGROUND OF THE INVENTION

In today's electrical supply systems, there are occasions when alternate sources of electric power are necessary or desirable. For example, the capability of switching from utility power to emergency generator power is extremely important for many businesses, hospitals and industries, and is also being employed in residential applications.

In certain applications, it is desirable for separate electrical circuits or even separate groups of electrical circuits to be arranged so that when one group of circuits is switched to a conductive state, another group of circuits is switched to a non-conductive state in alternating fashion. In some arrangements, it may be desirable to alternately switch a common load between separate power sources, so that as one power source is disconnected from the load, the second power source is connected after a negligible delay, to prevent any or minimal interruption of power to the load. In order that the desired period of alternate switching may be effective essentially simultaneously, a need has been recognized to employ a coupling mechanism which functions to switch one group of circuits OFF as the other group of circuits is switched ON.

One type of interlock for first and second tandemly aligned circuit breaker switches having first and second operating handles thereon is disclosed in U.S. Pat. No. 5,648,646 issued Jul. 15, 1997 to Flegel. In the '646 patent, the interlock includes a linkage arrangement in the form of first and second link members for applying a linear force between the first and second operating handles. Each of the operating handles defines a pair of oppositely facing sides which receive fasteners for connecting the link members thereto. A pair of retainer members aligns and maintains the fasteners in the operating handles. Each link member is provided with at least one slot and is connected to the first operating handle such that the first link member is disposed adjacent one of the oppositely facing sides of the first handle, and the second link member is disposed adjacent the other of the oppositely facing sides of the first handle. Further, each link member is connected to the second operating handle such that the first link member is disposed adjacent one of the oppositely facing sides of the second handle, and the second link member is disposed adjacent the other of the oppositely facing sides of the second handle. The link members are constructed and arranged such that pushing the first operating handle from an OFF position to an ON position pushes the second operating handle from an ON position to an OFF position.

While the above-described linkage arrangement operates satisfactorily, it remains desirable to provide a more simplified and economical mechanism which automatically turns one circuit breaker OFF when an adjacent circuit breaker is turned ON. Such a mechanism should assure that the main contacts of both circuit breakers cannot be closed at the same time. It is also desirable that this mechanism does permit, however, both of the circuit breakers to be switched OFF at the same time.

SUMMARY OF THE INVENTION

The present invention advantageously provides an improved interlock for circuit breakers installed in a standard load center for the specific purpose of providing a simple and safe arrangement for supplying power to the selected circuits from an alternate power source, such as a portable generator, during a utility power outage. The interlock of the present invention is guided along an upper surface of the circuit breakers so that there is an improved distribution of force between the operating handles. The present invention enables the use of standard, off-the-shelf circuit breakers which may be retrofitted without any modification of the circuit breaker, without fastening the interlock to the circuit breakers and without the need for special assembly tools.

In one aspect of the invention, there is provided an interlock for first and second tandemly aligned circuit breaker switches respectively having first and second external operating handles thereon oriented such that the operating handles are disposed away from each other when the switches are OFF and towards each other when the switches are ON. Each of the operating handles has an inwardly facing surface and an outwardly facing surface. The interlock takes the form of a substantially inflexible control member movably and retainably mounted relative to the switches. The control member has first and second spaced stops, each of the stops being disposed between the operating handles for engagement therewith. The control member is constructed and arranged such that pushing the first operating handle from an OFF to an ON position pushes the second operating handle from an ON to an OFF position. The switches each define an outward face and the control member moves in a plane parallel to the faces of the switches. The control member includes a planar base strip having first and second stops which extend upwardly therefrom. The base strip includes a pair of opposed outer ends, each of the outer ends extending through a recess formed in a respective handle to at least one of the outwardly facing surfaces of one of the handles when the switches are in the OFF position. The first and second stops define opposed ends of a bight portion disposed upon the base strip. The first and second stops and the bight portion form a U-shaped force transmission member. The base strip includes a first half and a second half, each of the halves having an inner end spaced from one of the outer ends. Each of the inner ends of the base strip halves are juxtaposed and fastened to an underside of the bight portion. The U-shaped force transmission member is attached to the base strip by means of a set of fasteners passing through a set of aligned apertures in the bight portion of the force transmitting member and the inner ends of the base strip halves. The control member includes guide structure for guiding the control member along a central groove defined by the existing structure of the switches. The guide structure is defined by pins depending from the base strip into the groove. At least one of the pins is defined by one of the fasteners. The first and second stops are spaced in linear distance from each other, such that the first stop forces the first operating handle over-center to the OFF position before the second operating handle reaches the ON position.

The invention also contemplates an interlock for first and second tandemly aligned and adjacently disposed circuit breakers. The circuit breakers have switches which respectively have first and second operating handles thereon, and a control member is movably mounted on the switches such that moving the first operating handle from an OFF position to an ON position moves the second operating handle from an ON to an OFF position. The invention control member is installable upon the switches without fastening the control member to the switches, without separating the switches and without deforming the control member. The control member includes a pair of spaced stops disposed between the operating handles for engagement therewith. The operating handles are each formed with a recess therethrough, and the control member has opposed ends, each of which extends through one of the recesses.

The invention further contemplates an interlock for first and second tandemly aligned and adjacently disposed circuit breakers respectively having first and second external operating handles thereon, and a control member movably mounted on the switches such that moving the first operating handle from an OFF position to an ON position, moves the second operating handle from an ON position to an OFF position. The invention includes guide structure for guiding the control member along a longitudinal path defined by a groove formed by the existing structure of the switches and enabling an even distribution of forces between the operating handles. The guide structure includes pins depending from opposed ends of the control member and includes at least one pin depending from the control member between the operating handles.

In yet another aspect of the invention, there is provided an interlock for first and second tandemly aligned circuit breaker switches respectively having first and second external operating handles thereon oriented such that the operating handles are disposed away from each other when the switches are in an OFF position and towards each other when the switches are in an ON position, each of the handles having an inwardly facing surface and an outwardly facing surface. The interlock includes a pair of planar base strip halves, each having an inner end and an outer end, and a U-shaped force transmission member including a planar bight portion having opposed outer ends terminating in spaced first and second upwardly extending stops disposed between the operating handles for engagement therewith. The bight portion is fixed to the inner ends of the strip halves such that the outer ends of the base strip halves extend through each of the recesses formed in the operating handles. The interlock may have one of the base strip halves attached to the U-shaped force transmission member and at least one pin passing through aligned apertures in the bight portion and the other of the base strip halves. The outer ends of the base strip halves may be provided with depending pins guided in the groove.

The invention further contemplates a method of interconnecting first and second switch handles, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a front elevational view of a load center panel having an array of opposed circuit breakers, at least one pair of which is interconnected by the interlock embodying the present invention;

FIG. 2 is an enlarged, front elevational view of a lower portion of the load center panel of FIG. 1 incorporating the interlock of the present invention;

DETAILED DESCRIPTION OF THE INVENTION

Figure 3:
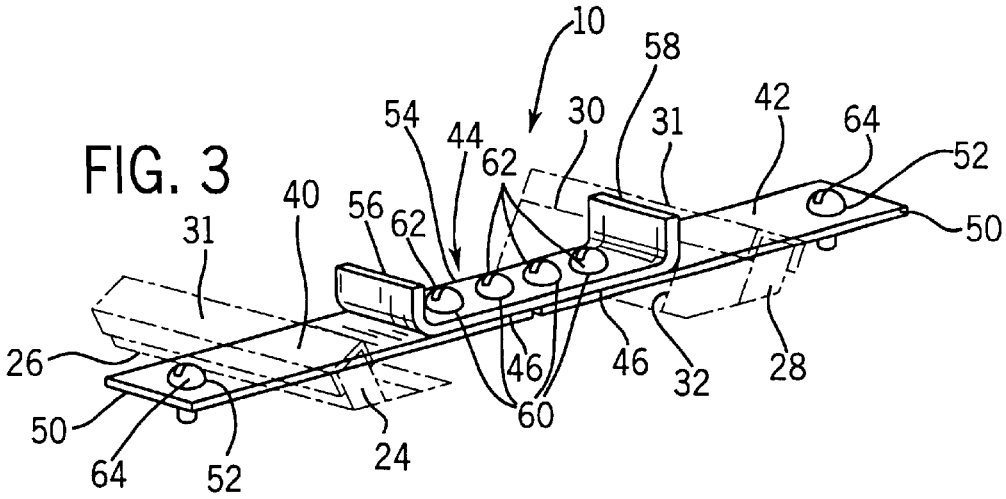
FIG. 3 is an isolated, isometric view of the interlock as shown in FIGS. 1 and 2.

The preferred embodiment of the inventive interlock of circuit breaker switches is generally identified in FIGS. 1–7 by the reference numeral 10 and is shown in connection with circuit breaker switches 12, 14, 16 and 18. The circuit breaker switches depicted in the drawings are standard, commercially available electrical mechanisms of the type manufactured by the ITE Circuit Protection Division of Siemens Energy and Automation Inc. They are further identified by the manufacturers as Type QP, double pole. Such circuit breaker switches are conveniently snapped into a conventional load center panel 20 provided with a hinged door 22 and beneath which panel are positioned panel buses. It is the usual design for circuit breaker switches of this type to have spring biased, over-the-center switch members or operating handles such as 24, 26, 28 and 30. In normal operations, these handles may be employed to manually ON and OFF switch the circuit control by that switch. Normally, such switches are designed such that when the electrical device is ON switched and a current overload occurs, the internal mechanism causes the device to OFF switch. Thus, both switching functions are combined in a single unit.

It is standard to mount a pair of circuit breaker switches such as 12 and 14, and 16 and 18, in laterally adjacent pairs so that they may be interconnected and ganged together. In the particular switches shown, ganging of a pair of switches is obtained by a tie bar or cap 31 which bridges operating handles 24 and 26, and 28 and 30, and the switches may also be interconnected via internal connections, in a manner as is known. With cap 31 in place, a recess such as 32, FIGS. 2 and 3, is formed between operating handles 24 and 26, and 28 and 30 through which the interlock 10 is inserted. It should be understood, however, that such operating handles may be unitarily formed together or otherwise joined. Each of the joined handles has an inwardly facing surface 33 and an outwardly facing surface 34. In addition, switches 12 and 16, and 14 and 18 are in opposed relationship such that the switches are also tandemly aligned. In the preferred embodiment to follow, it will be assumed that the switches 12 and 14 are fed from power from an electrical utility and the switches 16 and 18 are fed by an alternate power source, such as a portable power generator. The bottom portion of load center panel 20 may include a power inlet 35 for the generator and wattage meters 36 for monitoring current draw of the generator. Other circuit breaker switches 37*a* and 37*b* are positioned along the paneled bus to control the supply of power to branch circuits, either when power is supplied to panel 20 from a utility through switches 12 and 14 or from an alternate power source through switches 16 and 18. Tandemly aligned circuit breaker switches 12 and 16, and 14 and 18 are oriented such that the operating handles 24 and 26, and 28 and 30 are positioned away from each when the switches are OFF and are oriented toward each other when the switches are ON.

In accordance with the invention, circuit breaker switches 12, 14, 16 and 18 are provided with the interlock 10 for preventing switches 12, 14 and 16, 18 from being in the ON position at the same time. Otherwise stated, interlock 10 of the present invention ensures that a pair of circuit breaker switches mounted in opposed orientation with their operating handles mechanically interconnected will be mutually constrained, so that only one of the circuit breaker switches can be in the ON position at any one time. While the interlock 10 prohibits both circuit breaker switches from being ON at the same time, it does allow both circuit breaker switches to be in the OFF position siua simultaneouslyawill be appreciated hereinafter.

Interlock 10 is in the form of a substantially inflexible control member disposed across coplanar, outward faces 38 of the circuit breaker switches 12, 14, 16 and 18 for applying a linear force between operating handles 24, 26, 28 and 30. More particularly, interlock 10 is adapted to be slidably mounted and retained along a central, longitudinal path defined by the recesses 32 in the handles. As will be further described below, the interlock 10 is also guided above and along a path defined by a groove or channel 39, FIG. 2, formed by the existing structure of the switches, namely the faces 38. The preferred interlock 10 is comprised of a pair of identical, elongated, planar base strip halves 40 and 42 of substantially rectangular configuration, and a U-shaped force transmission member 44 adapted to be positioned between the base strip halves when they are aligned as set forth hereafter. Both the strip halves 40, 42 and the force transmission member 44 are typically formed of a rigid, metallic material which resists deformation. Each of the base strip halves 40, 42 has an inner end 46 formed with a pair of adjacently disposed screw-threaded apertures 48 (FIG. 4) and an outer end 50 provided with a single screw-threaded aperture 52. The force transmission member 44 is preferably a one-piece component having a planar bight portion 54 connecting opposed ends which are bent upwardly at substantially right angles relative to the bight portion. The ends define a first stop 56 and a second stop 58 adapted to be positioned between the operating handles 24, 26, 28 and 30 for respective engagement with the inwardly facing surfaces 33 of the handles. The bight portion 54 is equal to the base strip halves 40, 42 in width, and is formed with four holes 60 (FIG. 3) which are designed to be aligned with the apertures 48 formed in the inner ends 46 of the base strip halves 40, 42.

As a salient feature of the invention, interlock 10 is quickly and easily installable for sliding movement upon the faces 38 of the switches 12, 14, 16 and 18 without fastening the interlock 10 to the switches, without separating the switches as they are installed in the load center 20 and without deforming the interlock 10.

Figure 4:
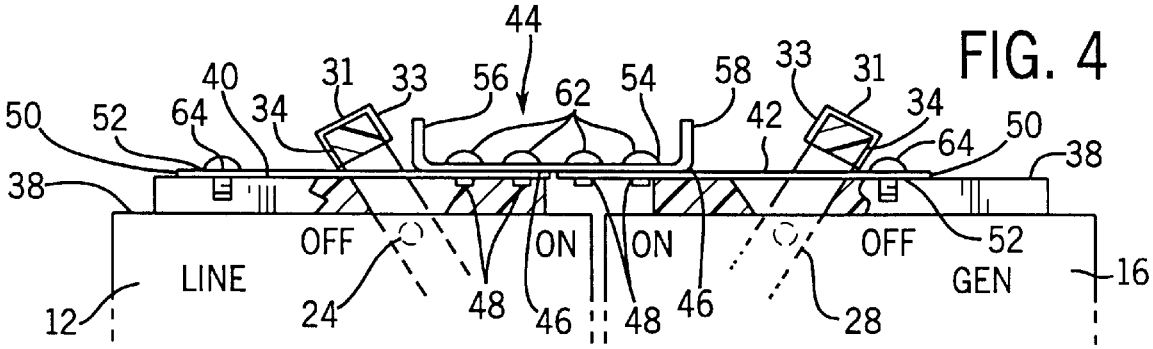
FIG. 4 is a partial sectional view taken on line 4–4 of FIG. 2 showing the interlock with opposed circuit breakers both in the OFF position.

Referring now to FIGS. 3 and 4, preferably with both switch handles 24 and 28 in the OFF position, each base strip half 40, 42 is inserted through a respective recess 32 in the operating handles such that the inner ends 46 are juxtaposed or placed adjacent each other. An underside of force transmission member 44 is then placed on top of the aligned base strip halves 40, 42, so that apertures 48 and holes 60 are aligned. A set of four screws 62 is then inserted into the holes 60 and tightened so as to rigidly join the three main components 40, 42, 44 together. The distance between the first stop 56 and second stop 58 is predetermined such that first stop 56 forces operating handle 24 over-center to the OFF position before operating handle 28 reaches the ON position. In addition, the length of a base strip formed by the joined base strip halves 40, 42 is chosen such that the outer ends 56 extend at least to, and preferably beyond, the outwardly facing surfaces 34 when the operating handles are in the OFF position. With this construction, the interlock 10 is movably retained relative to the switches 12, 14, 16 and 18.

As a further feature of the invention, the interlock 10 is provided with a screw 64 threaded into each aperture 52 on the outer ends 50 of the base strip. The depending shafts of the screws 62, 64 project into the groove 39 formed in the faces 38 of the switches and define guide structure for guiding the interlock 10 along the central path formed by the existing structure of the switches. The guide structure enables a more even distribution of force when the operating handles are pushed. Alternatively, the invention contemplates the use of rivets or depending pins in the place of certain screws. It should be understood that other arrangements providing the same results fall within the scope of the invention. For example, one of the base strip halves 40 or 42 may be fixed to the force transmission member 44 so that only one fastener or other connecting mechanism, such as a snap fit, is required to join the preassembled base strip half 40 or 42 and force transmission member 44 with the other base strip half 40 or 42.

Figure 5:
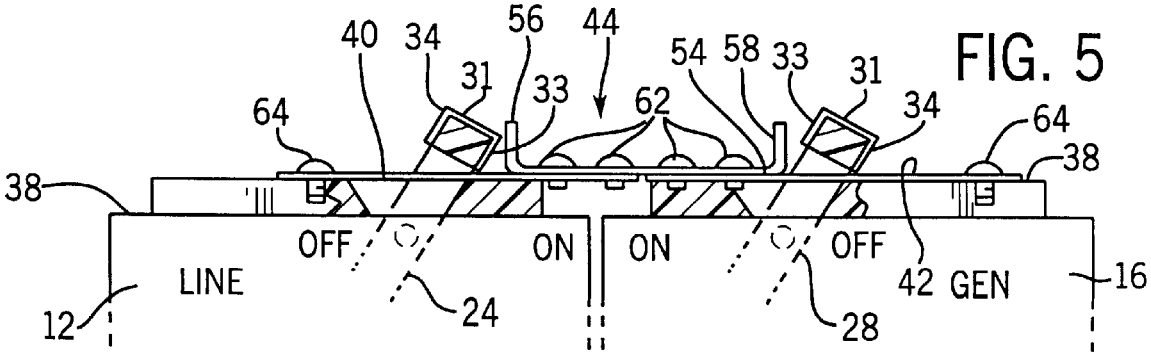
FIG. 5 is a view similar to FIG. 4 showing the position of the interlock during utility power transmission.
Figure 6:
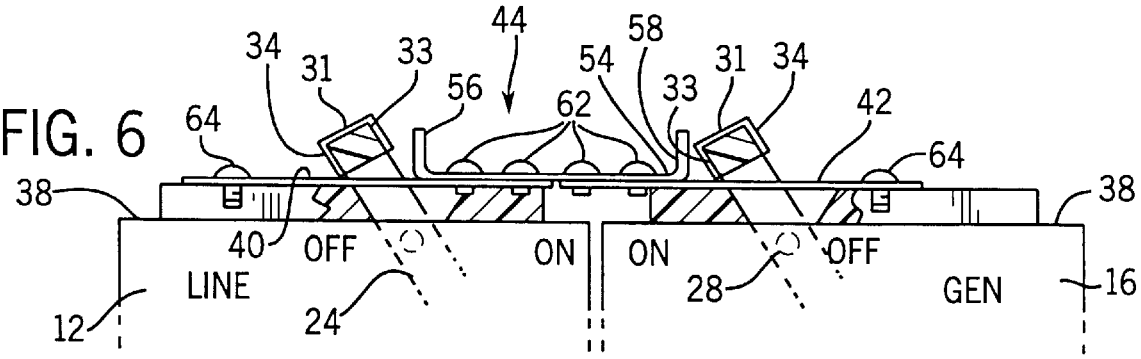
FIG. 6 is a view similar to FIG. 5 showing the position of the interlock upon a utility power interruption for supplying power from an alternate power source.
Figure 7:
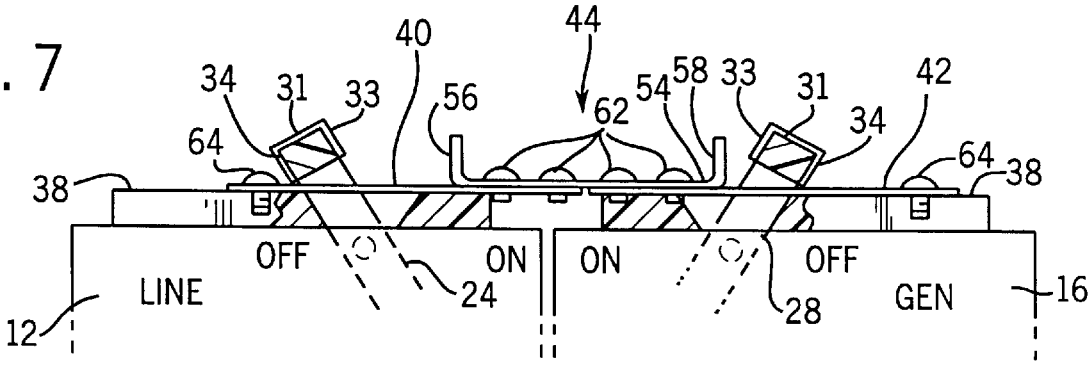
FIG. 7 is a view of the interlock as returned to the position of FIG. 4

FIGS. 5, 6 and 7 illustrate sequential representations of a switching operation during a typical utility power transmission and a typical utility power interruption. In FIG. 5, switch 12 is on the ON position and switch 16 is in the OFF position under normal operating conditions when the electrical utility power is uninterrupted and fully available. With switch 12 ON, the panel bus is fed from the electric utility. Switch 16 is OFF and no power can be transmitted to or from the generator. FIG. 6 illustrates the switch action which occurs during a utility power interruption. Switch 12 has been feeding utility power into the panel bus but that power has now been interrupted. Power from a portable generator, or other alternative source, is now fed to switch 16 which is to be manually turned on. As operating handle 28 is moved towards the ON position, operating handle 24 is simultaneously moved by stop 56 of transmission member 44 until it comes under the influence of a conventional biasing means such as a spring, to the OFF position. As previously noted, the distance between the first stop 56 and the second stop 58 is such that first stop 56 pushes operating handle 24 over-center to the OFF position before operating handle 28 reaches the ON position. FIG. 6 shows the operating handle 28 subsequently moved over to the ON position. Power is now being fed through switch 16 from the alternate generator source to the panel bus. Switch 12 is OFF and portable generator power is unable to be fed to the utility supply. Likewise, if power is restored, it will be unable to feed the panel bus. Circuit breakers 12 and 16 remain in the FIG. 6 position as long as utility power is unavailable.

Upon restoration of utility power, the above-described sequence is reversed beginning with FIG. 6. As the operating handle 24 is pushed to the ON position, first stop 56 is pushed such that second stop 58 will push operating handle 28 towards the OFF position until the operating handles 24, 28 reach the position shown in FIG. 5. The sequence of events is ready to begin again in FIG. 6 at the next power outage. While the interlock 10 prevents both circuit breakers 12, 16 from being ON at the same time, it does allow both breakers to be OFF at the same time. Operating instructions do, in fact, recommend that one breaker be turned OFF before the other breaker is turned ON, although this is not entirely necessary as the specific intent of the interlock design is to prevent both breakers from being ON simultaneously. FIG. 7 illustrates both breakers in the OFF position, as shown in FIG. 4.

It should be appreciated that as the interlock 10 shifts back and forth upon the switches in a plane parallel to the faces 38, the pin structure depending from interlock 10 and riding in groove 39 enables a centralized application of force. This ensures that the switch handles 24, 28 are not skewed due to an uneven application of force. The guide function provided by the screws 62, 64 in the grooves 39 also prevents the interlock 10 from skewing due to lateral displacement within the recesses 32 formed in the handles. The rigidity and length of the interlock 10 further contribute to the improved application of force and a more directed switching motion.

It should also be appreciated that the present invention provides an improved interlock 10 employing a guided, non-fastener-type connection with the circuit breaker switches to ensure that the switches mounted in opposed orientation with operating handles mechanically interconnected will be mutually constrained so that only one of the switches can be in the ON position at any one time.

Unlike prior art interlocks which require modification to the switches or handles, fastener mounting or deformation of the interlock, the present invention provides a control member interlock having a small number of components which are economical and portable enough to be carried such as in an electrician's toolbox. The present invention provides an interlock which is installed and removed quickly and easily without the need for screws and other fasteners that penetrate the body of the switches or handles and without the need for special tools. Accordingly, interlock 10 is quickly and easily installed either in a production process or in the field when retrofitting an existing panel.

While the invention has been described with reference to a preferred embodiment, those skilled in the art will appreciate that certain substitutions, alterations and omissions may be made without departing from the spirit thereof. For example, while the preferred embodiment illustrates the invention as used in connection with tandemly aligned circuit breakers, the invention is equally adaptable to single circuit breakers and triple aligned circuit breakers. Accordingly, the foregoing description is meant to be exemplary only, and should not be deemed limitative on the scope of the invention set forth with the following claims.

I claim:

1. An interlock for first and second aligned switches respectively having first and second external switch members oriented such that the switch members are disposed away from each other when the switch members are in an OFF position, and towards each other when the switch members are in an ON position, said interlock comprising:

a control member movably and retainably mounted relative to said switches, said control member having first and second spaced stops, each of said stops being disposed between said switch members for engagement therewith, wherein said control member and stops are constructed and arranged such that pushing said first switch member from an OFF to an ON position pushes said second switch member from an ON to an OFF position.

2. The interlock of claim 1, wherein said switches each define an outward face, and wherein said control member moves in a plane parallel to said faces of said switches.

3. The interlock of claim 1, wherein said control member includes a planar base strip and wherein said first and second stops extend upwardly therefrom.

4. The interlock of claim 3, wherein said base strip includes a pair of opposed outer ends, each of said ends extending through a recess formed in one of said switch members.

5. The interlock of claim 3, wherein said first and second stops define opposed ends of a bight portion disposed upon said base strip, said first and second stops and said bight portion forming a U-shaped force transmission member.

6. The interlock of claim 5, wherein said base strip is comprised of a first section and a second section, each of said sections having an inner end and defining one of said outer ends.

7. The interlock of claim 6, wherein each of said inner ends are juxtaposed and fastened to an underside of said bight portion.

8. The interlock of claim 6, wherein said U-shaped force transmission member is attached to said base strip by means of a set of fasteners passing through a set of aligned apertures in said bight portion of said force transmission member and said inner ends of said base strip.

9. The interlock of claim 3, wherein said control member includes a pair of guide members, each of which guides said control member along a groove defined by the structure of one of said switches.

10. The interlock of claim 9, wherein each said guide member comprises a guide pin depending from said base strip into said groove.

11. The interlock of claim 10, wherein said first and second stops define ends of a force transmission member interconnected with said planar base by means of a set of fasteners, and wherein at least one of said guide pins is defined by one of said fasteners.

12. The interlock of claim 1, wherein said first and second stops are spaced a linear distance from each other such that said first stop forces said first operating handle over-center to the OFF position before the second operating handle reaches the ON position.

13. In an interlock for first and second aligned switches respectively having first and second switch members thereon, and interlock operable to move said first switch member from an ON position to an OFF position as said second switch member is moved from an OFF position to an ON position, the improvement wherein:

said interlock comprises a control member installable upon said switches without fastening said control member to said switches, without separating said switches and without deforming said control member.

14. The improvement of claim 13, wherein the control member includes a pair of spaced stops disposed between the switch members for engagement therewith.

15. The improvement of claim 14, wherein said switch members are each formed with a recess therethrough and said control member has opposed ends, each of said ends extending through one of said recesses such that said control member is slidably retained upon said switches.

16. In an interlock for first and second aligned switches respectively having first and second external switch members thereon, and a control member movably mounted on the switches such that moving said first switch member from an OFF position to an ON position moves said second switch member from an ON position to an OFF position, wherein said switches define an axial groove extending along the direction of movement of the switch members the improvement comprising:

guide structure interconnected with the control member and engaged within the axial groove of the switches for guiding said control member along a longitudinal path defined by the groove.

17. The improvement of claim 16, wherein said guide structure includes pins depending from opposed ends of said control member.

18. The improvement of claim 17, wherein said guide structure further includes at least one pin depending from said control member between said switch members.

19. An interlock for first and second aligned switches respectively having first and second external switch members thereon oriented such that the switch members are disposed away from each other when the switch members are in an OFF position, and towards each other when the switch members are in an ON position, each of the switch members having a recess, said interlock comprising:

a pair of planar base strip sections, each having an inner end and an outer end; and a U-shaped force transmission member including a planar bight portion having opposed outer ends terminating in spaced first and second upwardly extending stops disposed between said switch members for engagement therewith, said bight portion being fixed to each said base strip section adjacent its inner end, wherein said outer end of each base strip section extends through the recess of one of said operating handles.

20. The interlock of claim 19, wherein one of said base strip sections is attached to said U-shaped force transmission member, and wherein at least one pin passes through aligned apertures in said bight portion and the other of said base strip sections.

21. The interlock of claim 20, wherein said outer ends of said base strip sections are provided with depending pins guided in a groove defined by said first and second switches.

22. A method of interconnecting first and second switch members which are movable along a common axis, wherein each switch member is movable between an ON position and an OFF position, comprising placing a control member between the switch members without connection of the control member to the switch members, wherein the control member includes engagement surfaces which interact with the switch members for moving the second switch member to its OFF position when the first switch member is moved toward its ON position, and for moving the first switch member to its OFF position when the second switch member is moved toward its ON position.

23. The method of claim 22, wherein each switch member includes a recess, and wherein the control member includes portions which extend into the recess for maintaining engagement of the control member with the first and second switch members.

24. The method of claim 23, wherein each of the first and second switch members are connected to a switch defining an axially extending groove, and wherein the control member includes guide structure extending into the groove of each switch for guiding movement of the control member relative to the switches.

25. The method of claim 23, wherein the control member comprises an engagement member defining the engagement surfaces, and wherein the engagement member is mounted to a base member movably engaged with the switch members.

26. The method of claim 25, wherein the base member comprises a pair of base member sections, each of which extends into a recess associated with one of the switch members, and wherein the engagement member is mounted to and interconnects the base member sections.

* * * * *

UNITED STATES PATENT AND TRADEMARK OFFICE

CERTIFICATE OF CORRECTION

PATENT NO. : 6,031,193
DATED : February 29, 2000
INVENTOR(S) : David D. Flegel

It is certified that error appears in the above-identified patent and that said Letters Patent is hereby corrected as shown below:

Claim 13, column 8, line 32, after "and" insert -- an --.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*